United States Patent [19]

Minalga

[11] 4,016,821

[45] Apr. 12, 1977

[54] ELECTRONIC CONTROL OF BIGHT, FEED AND FEED BALANCE IN A SEWING MACHINE

[75] Inventor: Philip Francis Minalga, Piscataway, N.J.

[73] Assignee: The Singer Company, New York, N.Y.

[22] Filed: July 16, 1975

[21] Appl. No.: 596,683

[52] U.S. Cl. ..... 112/158 E; 112/65; 318/571

[51] Int. Cl.[2] ..... D05B 3/02

[58] Field of Search ..... 112/158 E, 121.12, 121.11, 112/203, 65, 67; 318/571, 567, 569, 560, 574, 575

[56] References Cited

UNITED STATES PATENTS

| | | | |
|---|---|---|---|
| 3,306,242 | 2/1967 | Szostak | 112/65 X |
| 3,568,072 | 3/1971 | Rosener | 318/571 X |
| 3,766,460 | 10/1973 | Hentz et al. | 318/571 |
| 3,835,360 | 9/1974 | Kiwiet | 318/571 X |
| 3,872,808 | 3/1975 | Wurst | 112/158 E |

*Primary Examiner*—Werner H. Schroeder
*Assistant Examiner*—Peter Nerbun
*Attorney, Agent, or Firm*—Edward L. Bell; Robert E. Smith; Edward P. Schmidt

[57] ABSTRACT

An improvement in a logic controlled sewing machine which permits an operator to vary by electronic means ornamental pattern bight and feed, manual stitch control, or individually control forward and reverse feed to achieve, for example, an optimum balanced buttonhole or ornamental variations to patterns. Operator influenced means are effective to signal the logic to apply a holding signal to FET switches, maintaining the FET switch in the conductive state. Closing of the FET switch inserts the wiper of a rheostat in bypass arrangement in the feedback circuit of an operational amplifier between a digital-to-analog converter for feed or bight and, respectively, a feed or bight servo amplifier system. By changing the magnitude of the resistance in the feedback circuit of the operational amplifier, the gain may be altered, thereby to control the signal to the feed or bight linear actuator for variation of stitch length or pattern width, respectively. An additional FET switch is maintained in the conductive state by the logic means only during reverse feed thereby applying a variable voltage to a summing point prior to the servo amplifier for exclusive control of reverse stitch length during pattern stitching.

16 Claims, 6 Drawing Figures

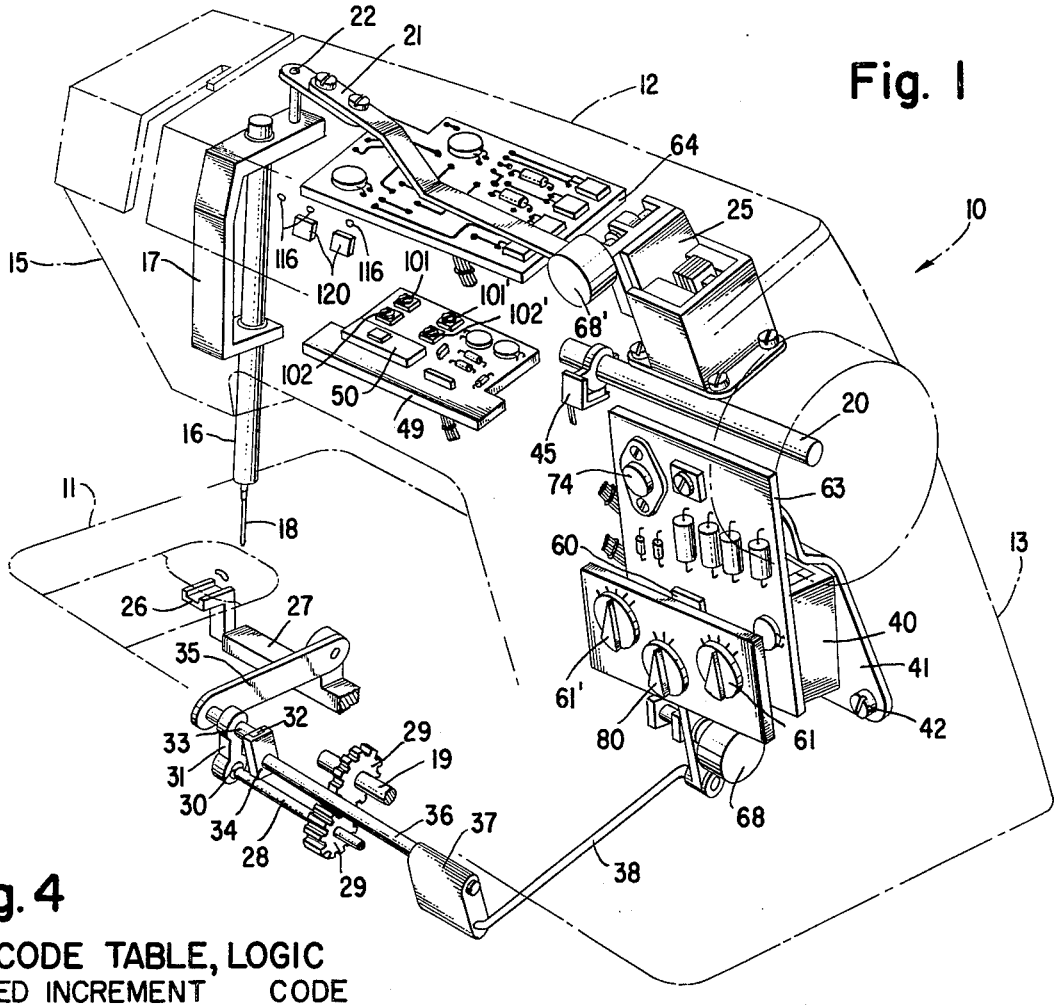
Fig. 1
Fig. 4
CODE TABLE, LOGIC
| FEED INCREMENT | CODE |
|---|---|
| 0.138 | 00000 |
| 0.128 | 00001 |
| 0.118 | 00010 |
| 0.108 | 00011 |
| 0.099 | 00100 |
| 0.089 | 00101 |
| 0.079 | 00110 |
| 0.070 | 00111 |
| 0.060 | 01000 |
| 0.050 | 01001 |
| 0.041 | 01010 |
| 0.031 | 01011 |
| 0.021 | 01100 |
| 0.011 | 01101 |
| 0.000 | 01111 |
| -0.011 | 10001 |
| -0.021 | 10010 |
| -0.031 | 10011 |
| -0.041 | 10100 |
| -0.050 | 10101 |
| -0.060 | 10110 |
| -0.070 | 10111 |
| -0.079 | 11000 |
| -0.089 | 11001 |
| -0.099 | 11010 |
| -0.108 | 11011 |
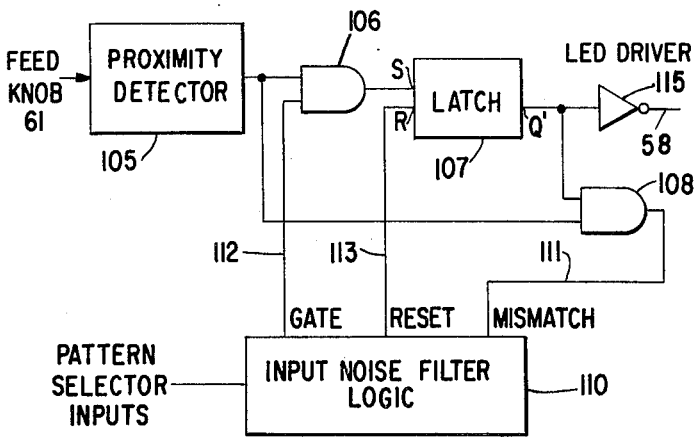
Fig. 6

ELECTRONIC CONTROL OF BIGHT, FEED AND FEED BALANCE IN A SEWING MACHINE

BACKGROUND OF THE INVENTION

A system is disclosed in the U.S. patent application Ser. No. 431,649 filed on Jan. 8, 1974 wherein logic means are used to select and release stitch information stored in memory means in timed relation with the operation of a sewing machine. Digital information from the memory means is converted to positional analog signals which control closed loop servo means including moving coil linear actuators directly controlling the position of conventional stitch forming instrumentalities of a sewing machine in the formation of ornamental patterns.

In this prior art system no means was disclosed for adjusting the feed pattern for ornamental variation. In addition, in this prior art system, feed balance, for instance in a buttonhole, to have the appearance of one leg of a buttonhole generated during forward feed conform to the appearance of the other leg of the buttonhole generated during reverse feed, was achieved by a variable balance control voltage which decreased forward feed when increasing reverse feed and vice versa. Thus with the prior art system any adjustment of feed balance would affect the density of both legs of a buttonhole simultaneously but would not necessarily be optimized insofar as the desired stitch density for each leg of the buttonhole was concerned.

In this prior art system, bight adjustment was achieved by a scaling resistor which was found to have an adverse loading effect on the circuit, changing circuit parameters which influenced linearity.

What is required is a means of providing for feed pattern variation, a means to individually control forward and reverse feed to obtain for example an optimum buttonhole that would have a balanced appearance, and a means for obtaining bight adjustment which would not suffer from the above noted drawbacks.

SUMMARY OF THE INVENTION

In the present invention an operational amplifier, interposed between a digital-to-analog converter and the servo amplifier system for both feed and bight pattern information, utilizes a feedback loop including a rheostat, variable to control the gain of the buffer amplifier and thereby the analog input signal to the servo amplifier system.

A commercially available FET switch is biased and latched in the conductive state by logic means, on operator command, thereby to insert the wiper of the rheostat into the circuit of the feedback loop for adjustment of feed or bight during ornamental pattern stitching.

A similar FET switch may be placed in the conductive state as signalled by the logic means only during reverse feed. To accomplish the aforesaid, the logic means may sense some characteristic of reverse feed, or of forward feed which indicates an absence of reverse feed. Thus a balance control voltage from a potentiometer connected as a voltage divider to a double ended reference voltage of a power supply may be introduced at a summing point of the servo amplifier system to obtain separate control over reverse feed in order to achieve an optimum buttonhole or optimum aesthetic effect in ornamental stitching.

DESCRIPTION OF THE DRAWINGS

The subject matter which is regarded as the invention is particularly pointed out and distinctly claimed in the concluding portion of this specification. The invention itself, however, both as to its organization and method of operation thereof may be best understood by reference to the following description taken in connection with the accompanying drawings, in which:

FIG. 1 is a perspective view of a sewing machine including fragments of a typical driving mechanism and of a needle jogging and work feeding mechanism and illustrating the physical elements necessary to an embodiment of this invention applied thereto;

FIG. 4 is a code table for the feed indicating the code words for the various feed positions;

DESCRIPTION OF THE INVENTION

Figure 2:
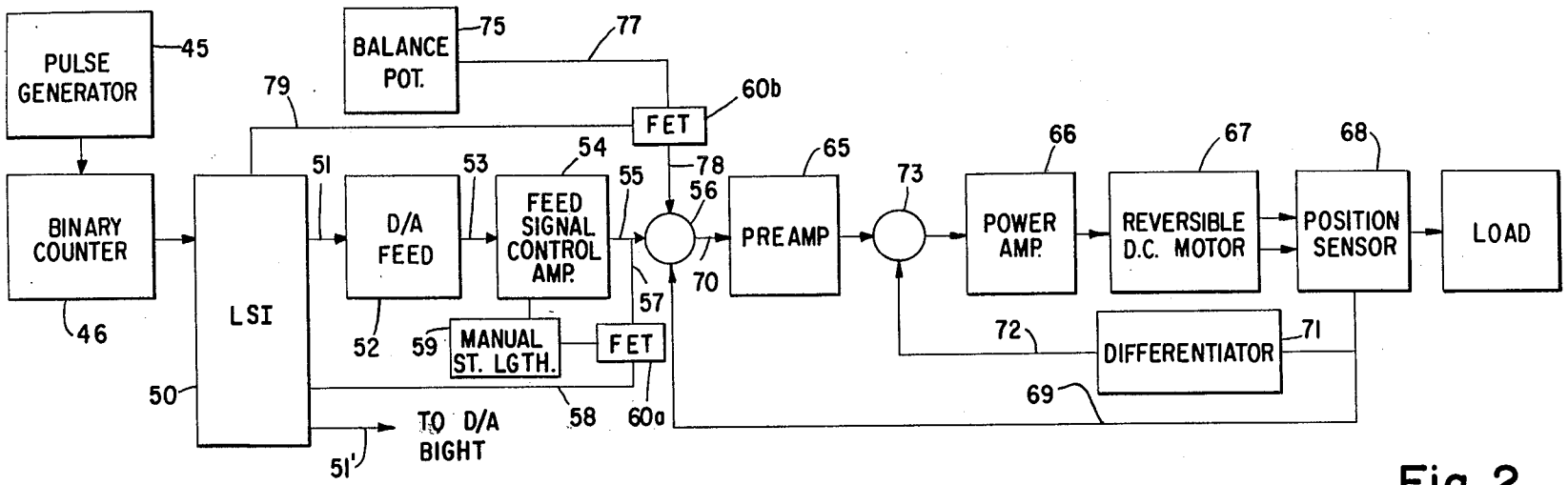
FIG. 2 is a general schematic block diagram of the feed portion of a system according to the present invention.

Referring to FIG. 1 there is shown in phantom a sewing machine casing 10 including a bed 11 and a bracket arm 12 supported in overhanging relation to the bed by a standard 13. The bracket arm 12 terminates in a head portion 15, within which is supported in a conventional manner a needle bar gate 17 which supports for endwise reciprocation therein a needle bar 16. The needle bar 16 is caused to undergo endwise reciprocation by an armshaft 20 by any conventional connection (not shown). The needle bar 16 carries in its extremity a needle 18 which cooperates with stitching instrumentalities (not shown) in bed 11 in the formation of sewing stitches.

The needle bar gate 17 is urged to impart lateral jogging motion to the needle bar 16 by a driving arm 21 pivoted to the needle bar gate as at 22. The driving arm 21 is connected to a reversible linear actuator 25 fully described and explained in the U.S. patent application Ser. No. 431,649, filed on Jan. 8, 1974, and assigned to the same assignee as the present invention, which is incorporated by reference herein. The linear actuator 25 is therefore used to determine lateral position of the sewing needle 18.

Also illustrated in FIG. 1 is a fragment of a work feed mechanism including a feed dog 26 carried by a feed bar 27. The mechanism illustrated for imparting work transporting movement to the feed dog includes a feed drive shaft 28 driven by gears 29 from a bed shaft 19, which is interconnected with the armshaft 20 in timed relationship by a conventional mechanism (not shown). A cam 30 embraced by pitman 31 is connected to a slide block 32, by pin 33, to reciprocate the slide block in a slotted feed regulating guideway 34. The pin 33 is also pivotably connected to horizontal line 35 which is itself pivotably connected to the feed bar 27. Thus for a given inclination of the guideway 34, a predictable horizontal motion of the slide block ensues and is transferred to the feed dog 26 by the horizontal link 35 and feed bar 27.

The inclination of the feed regulating guideway 34 may be adjusted by rotation of shaft 36 affixed to the guideway. The shaft 36 has a rock arm 37 affixed to the opposite extremity thereof which is connected by a rod 38 to a second reversible linear actuator 40 supported by support bracket 41 suitably attached to the sewing machine casing 10 by screws 42, only one of which is visible. Thus the linear actuator 40 is utilized to determine the feed rate of the sewing machine.

Referring to FIG. 2 there is depicted a general schematic block diagram for the feed controlling portion of the sewing machine only. The block diagram for bight control would be substantially similar except for differences to be further discussed below when referring to FIG. 5, the detailed circuit diagram of the servo amplifiers. The pattern information required to drive the linear actuators 25 and 40 originates preferably in a MOSFET Large Scale Integration (LSI) integrated circuit 50 (See also FIG. 1). A method by which the proper pattern information may be extracted from the LSI 50 to be presented to the respective digital to analog converters for bight and feed is disclosed in the U.S. Pat. No. 3,855,956, assigned to the same assignee as the present invention, which is hereby incorporated by reference herein. In that patent, a system is disclosed wherein digital information related to the positional coordinates for each stitch of a predetermined stitch pattern is stored in a static memory, such as the LSI 50. A pulse generator 45 (see also FIG. 1) driven in timed relation with the sewing machine produces a timing signal pulse between each successive stitch. These signal pulses are counted up in a counter to provide a time series of progressively increasing binary numbers corresponding to the progressively increasing number of stitches in the pattern. The counter output is applied as the address to the memory to recover as output therefrom the digital information related to the positional coordinates for each stitch of the predetermined pattern. The memory output is applied to control driving devices operatively connected to impart a controlled range of movement to the needle and the feed of the sewing machine to produce a specific predetermined position coordinate for the needle penetration during each stitch formation.

Thus in FIG. 2, the pulses from the pulse generator 45 are counted up in Binary Counter 46 and presented as address inputs to the LIS 50. The LSI 50, as shown in FIG. 1 is mounted on logic printed circuit board 49. The LSI 50 presents as output digital information related to the positional coordinates for each stitch in pulse width modulated form to digital-to-analog converters 52 for feed, and bight (not shown in FIG. 2). The LSI 50 may include a latch whereby the bight information may be held for later release to the bight servo system at a time appropriate to the operation of the needle jogging mechanism. Similarly the feed information may also be retained by a latch in the LSI 50 for later release to the feed servo system at a time appropriate to the operation of the feed regulating guideway 34. Proper timing for release of the bight or feed information may be determined by the pulse generator 45. Since the systems for the bight and for the feed are identical except for the specific switching necessary for balance control in the feed regulating system, the following description will for convenience, be confined to the feed system only and the specific switching for the balance control will be described later. Corresponding components in each system carry the same reference number except that the numbers associated with the bight or needle jogging system are primed.

Figure 5:
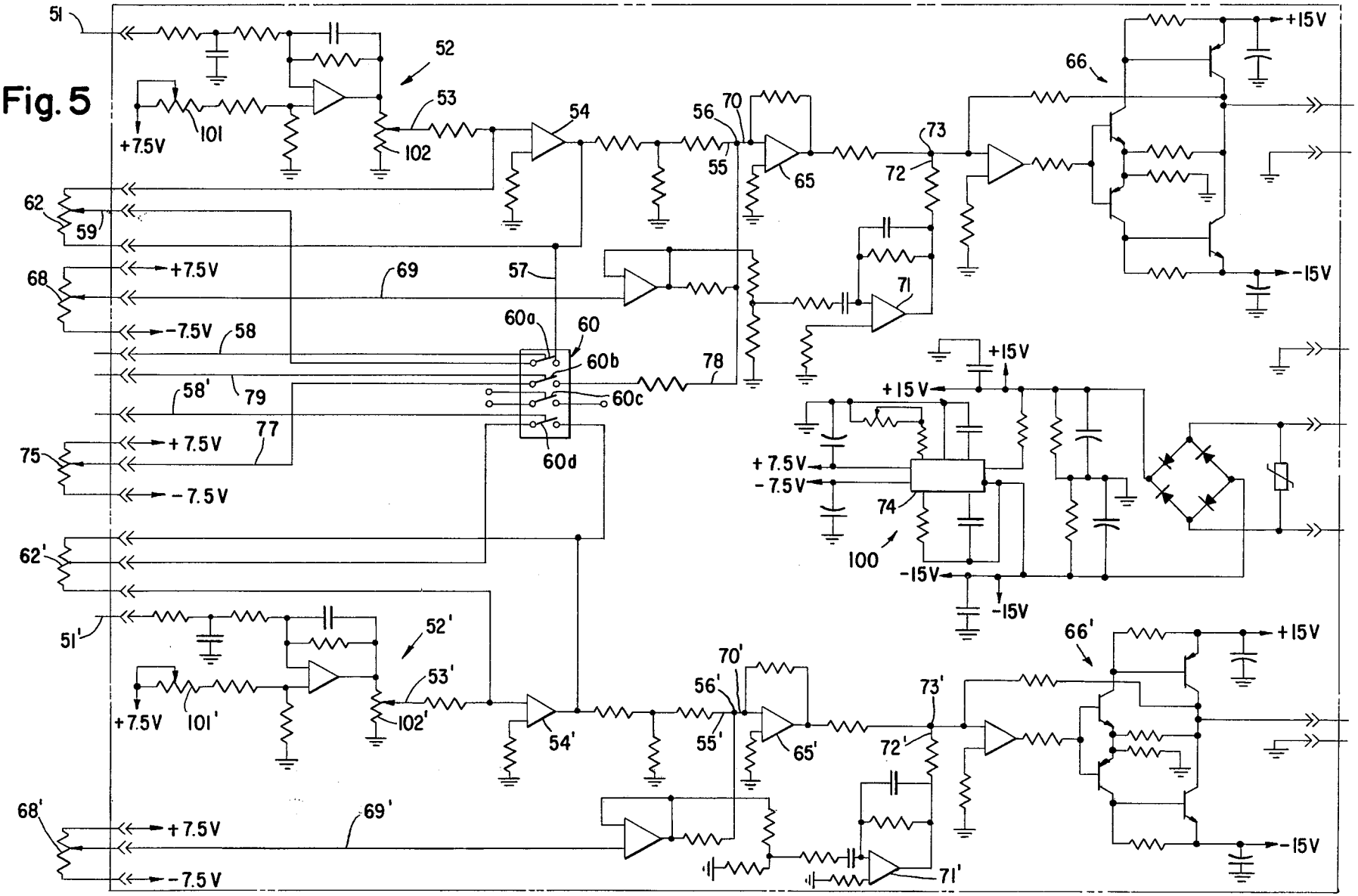
FIG. 5 is a detailed circuit diagram of the servo amplifiers, feedback loops and balance control according to this invention; and, FIG. 6 is a schematic block diagram of a preferred override latch arrangement for inserting the variable feedback loops shown in the circuit diagram, FIG. 5.

The pulse width modulated signal presented along line 51 to the digital-to-analog converter 52 is filtered, offset by voltage divider 101 and scaled by rheostat 102 in the converter in order to accommodate a specific LSI 50 to those components between the LSI and the load, to account for manufacturing variability (See also FIG. 5). The analog signal from the D/A converter 52 outputs on line 53 to a feed signal control amplifier 54, which outputs on line 55 to the summing point 56 of a low level preamplifier 65 of a servo amplifier system described in the aforereferenced patent application Ser. No. 431,649. Further description of the servo amplifier system will be given below.

The output from the feed signal control amplifier 54 is also transferred via line 57 to FET **60*a* of the enhancement type, having its gate connected by gate line 58 to the LSI 50. On suitable command the LSI 50 will apply a gate voltage through a latch circuit to FET 60*a* by way of gate line 58 thereby to place and retain FET 60*a* in the conductive or ON condition. A feedback signal then passes through line 57 and FET 60*a* to a wiper of a rheostat, constituting manual stitch length control block 59**.

Thus the gain of the feed signal control amplifier 54 may be controlled during pattern stitching or straight stitching. Referring to FIG. 1, the manual stitch length control rheostat 62, adjusted by knob 61, is mounted on power supply and override printed circuit board 63. Command to the LSI 50 to apply a gate voltage to FET **60*a* may be accomplished by a proximity switch, associated with knob 61, of the type described in the U.S. patent application Ser. No. 596,685 filed on July 16, 1975, entitled "Digital Differential Capacitance Proximity Switch." Rotation of knob 61 rotates wiper 59 of rheostat 62** for adjustment of feedback signal.

Referring to FIG. 6 there is shown a schematic block diagram of an override latch arrangement which may be implemented to retain, on operator command, the FET **60*a* in the ON condition for manual control of the feed signal. When the knob 61 (see FIG. 1) is touched by an operator, a proximity detector 105, of the type disclosed in the above referenced application, becomes active and presents an input signal to AND gate 106 and mismatch AND gate 108. If the feed override latch 107 is not set, that is the output Q′ is a logical 1, the mismatch AND gate 108 outputs a signal to an input noise filter logic 110 on mismatch line 111. If the signal remains on line 111 for a period of from 80–160 micro seconds, the filter logic 110 presents a pulse signal on gate line 112 to the second input of AND gate 106, thereby setting the latch 107 to output a logical 0 at Q′. The mismatch AND gate 108, having a logical 0 as an input ceases to output a signal to the filter logic 110. A LED driver 115, implemented by an inverter, inverts the logical 0 input to provide a control signal to FET 60*a* by way of gate line 58 and to indicating LED's 116 mounted on a control panel (See FIG. 1**).

The input noise filter logic 110 may also receive a signal from pattern selection buttons 120, also located on a control panel, which, if maintained for 80–160 micro sections, causes the filter logic to send a reset pulse along reset line 113 to reset the latch 107. The latch 107 outputs on Q′ a logical 1, until again set by a signal from proximity detector 105 as explained above.

A similar arrangement may be implemented for bight control, initiated by contact with knob 61′ (See FIG.

1). All of the components shown in FIG. 6, and the similar components required for bight control, may be implemented as part of LSI 50.

In the detailed circuit diagram of FIG. 5 the feed signal control amplifier 54 is indicated as an operational amplifier with rheostat 62 providing the feedback to the input. A MOSFET module 60, such as RCA type CD4016A, comprises four independent bilateral signal switches, one of which is 60*a*. The module may also be mounted on P.C. board 63 (see FIG. 1). As schematically indicated in FIG. 5 a voltage signal from LSI 50 on line 58 will place FET 60*a* in an ON condition, inserting the wiper 59, of rheostat 62 in bypass arrangement in the feedback circuit. Thereby feedback resistance of the operational amplifier 54 may be reduced to decrease to gain of the operational amplifier and reduce the analog signal to the summing point 56 of the low level preamplifier 65 of the servo amplifier systems mounted on servo circuit board 64 (see FIG. 1). The preamplifier 65 drives a power amplifier 66 which supplies direct current of reversible polarity to the electromechanical actuator 67, which in the broadest sense comprises a reversible motor, to position the actuator in accordance with the input analog voltage on line 55. A feedback position sensor 68 (see also FIG. 1) mechanically connected to the reversible motor 67 provides a feedback position signal on line 69 indicative of the existing output position. The input analog voltage and the feedback signal are algebraically summed at the summing point 56 to supply an error signal on line 70. The feedback signal from the position sensor is also differentiated with respect to time in a differentiator 71 and the resulting rate signal is presented on line 72 to the summing point 73 of the power amplifier 66 to modify the positional signal at that point. The position sensor 68 may be any device that generates an analog voltage proportional to position and may, in this embodiment, be a simple linear potentiometer connected to a stable reference voltage 74 (see FIG. 5) and functioning as a voltage divider. The differentiator 71 is preferably an operational amplifier connected to produce an output signal equal to the time rate of change of the input voltage as is well known in this art.

While the reversible motor 67 may be a conventional low-inertia rotary d.c. motor, it is preferable, for the purposes of the present invention that it takes the form of a linear actuator in which a lightweight coil moves linearly in a constant flux field and is directly coupled to the load to be positioned. This simplifies the driving mechanical linkage and minimizes the load inertia of the system.

Thus far it has been shown that the input to the feed (or bight) servo amplifier system may be attenuated to obtain a smaller pattern than is stored in the LSI 50, or for control of stitch length in straight stitch. However further control is required in the feed system to compensate for work related discrepancies such as the type and thickness of material being stitched, the pressure being applied by the presser foot and the rate of feed. Problems are usually encountered in closed pattern sewing, particularly in buttonhole stitching where the appearance of both legs of the buttonhole are ideally, identical, or balanced. Ornamental pattern stitching where the sewing needle is required to pass through a point in the work material more than once also presents a problem.

In the prior art sewing machines these work related discrepancies were accommodated by mechanically or electronically shifting the feed signal, however derived, in a fashion that altered forward feed while correcting reverse feed or vice versa. A system will now be described in which individual control over forward feed and reverse feed may be obtained in order to readily achieve an optimum balanced buttonhole or ornamental pattern, which also lends itself to ornamental variation not normally obtainable.

Referring to FIGS. 2 and 5, a manual balance control potentiometer 75 is connected as a voltage divider to the double ended reference voltage output of voltage regulator 74 in the power supply. The wiper of the balance control potentiometer 75 is connected by line 77 to FET 60*b*, which is connected by line 78 to the summing point 56. The gate of FET 60*b* is connected to LSI 50 by gate line 79. The LSI 50 applys a voltage to the gate line 79 to place the FET 60*b* in the ON condition only during reverse feed. Thus a balance control voltage, obtained by adjustment of knob 80 (see FIG. 1) attached to the wiper of balance control potentiometer 75 mounted on P.C. board 63, is introduced at summing point 56 only during reverse feed, thereby varying input voltage to the feed servo amplifier system only during reverse feed. During forward feed the FET 60*b* is in the OFF condition and the input to the feed servo amplifier system is responsive only to the output of the feed signal control amplifier 54 as adjusted by the knob 61 of the stitch length control rheostat 62.

Figure 3:
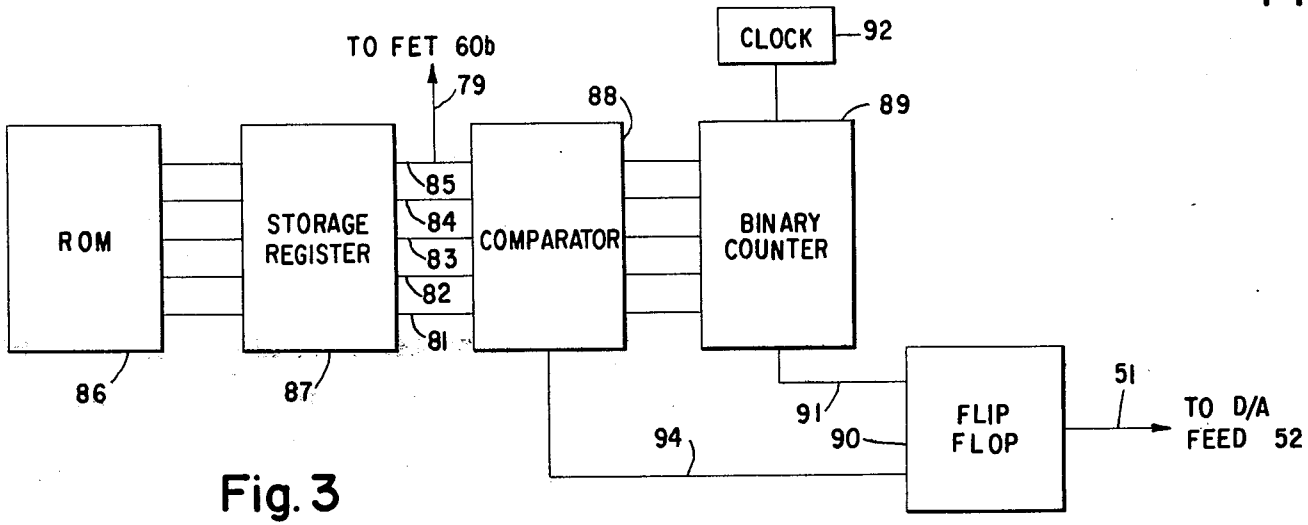
FIG. 3 is a schematic block diagram of a portion of the LSI indicating a method for sensing reverse feed.

A preferred method by which the LSI 50 will apply a control voltage to FET 60*b* only during reverse feed may be understood by reference to FIG. 3, which indicated in schematic block form a portion of LSI 50, and to FIG. 4, which sets out the binary code words for all the feed increments of which the sewing machine is capable. The feed code of FIG. 4 are stored in Read Only Memory (ROM) 85 in a predetermined sequence which in conjunction with bight code words similarly stored in a predetermined sequence, may be extracted by the pulse generator 45 and binary counter 46 seriatim, as explained above and in the reference U.S. Pat. No. 3,855,956, whereby the sewing machine 10 may generate an ornamental pattern.

As indicated in FIG. 3 the feed code word extracted from the ROM 86 is transferred to and retained in a storage register 87. Inspection of the Feed Logic Code table of FIG. 4 will disclose that for all reverse feed the most significant bit (MSB) 85 retained in the storage register 87 is a binary 1 or high voltage state. The remaining code words are retained in the storage register 87 on lines 81–84 including the least significant bit (LSB) 81. Thus in the preferred embodiment the MSB 85 may be directly connected via gate line 79 to the FET 60*b*, thereby to place the FET 60*b* in the ON condition during reverse feeding for the purpose of applying an adjustable balance voltage from balance control potentiometer 75 to the summing point 56.

The code word for a particular stitch retained in the storage register 87 is transferred via lines 81–85 to a comparator 88. A binary counter 89, running continuously, counts from 0 to 31 and reverts to zero. On the count of 31 a signal is transferred from the counter 89 to flip-flop 90 via line 91, turning on the flip-flop to introduce a voltage on line 51 to the digital-to-analog converter 52. A clock 92 issues counting commands to the binary counter 89 at approximately a 100 kilohertz rate. When a 5 bit code match is attained between the code word retained by the storage register 87 and presented to the comparator 88 and the count of the binary counter 89, the comparator sends a signal along line 94 to the flip-flop 90, turning off the flip-flop and, thereby, reducing the voltage signal on line 51 to zero. Thus, the digital signal is converted from parallel form to pulse width modulated serial form. The 100 kilohertz pulse rate of the clock 92 combined with the 32 bit counting capacity of counter 89 results in a pulse width modulated signal of approximately 3 kilohertz frequency on line 51 to the digital-to-analog converter 52.

While a preferred manner of sensing a reverse feed signal has been described, other methods also suggest themselves. Thus, logic circuits may be devised and implemented which are responsive to an absence of forward feed or zero feed which are characterized by a binary 0 or low voltage in the MSB 85. Also, logic circuits may be devised and implemented which are responsive to specific code words for reverse feed.

Referring to FIG. 5, a power supply circuit 100 is indicated which may be connected to the AC house mains via a transformer (not shown) supplying 12 volt 60 hertz to the power supply. The 12 volt AC supply undergoes full wave rectification and filtration to provide ± 15VDC to the power amplifiers and also to provide, through voltage regulator 74, ± 7.5 VDC to the bight and feed position potentiometers 68' and 68 respectively and to manual balance control potentiometer 75, as well as ± 7.5 VDC to the digital-to-analog offset voltage dividers 101 and 101' in the digital-to-analog converters 52 and 52' for feed and bight respectively (see also FIG. 1). Though not shown, the power supply 100 also provides ± 7.5 volts DC to LSI 50.

As previously stated all the bight components finding a counterparts in the feed system take the same number as the feed component except that the numbers are primed. Thus the two systems, as disclosed, differ only in the incorporation of a manual balance control potentiometer 75 which by way of line 77 and FET **60*b* conductive only during reverse feed as previously explained, applys an adjustable voltage signal to summing point 56** for control of voltage signal to the feed servo amplifier during reverse feed only.

Having thus set forth the nature of the invention what I seek to claim is:

1. In a sewing machine having stitch-forming instrumentalities positionally controlled over a predetermined range between stitches to produce a pattern of feed and of bight controlled stitches; logic means for storing pattern stitch information in digital form; means operating in timed relation with the sewing machine for recovering selected digital pattern stitch information from said logic means; feed digital-to-analog converter means and bight digital-to-analog coverter means for generating positional feed and bight analog signals, respectively, related to said selected digital pattern stitch information; and feed closed loop servo means including reversible electric motor and bight closed loop servo means including reversible electric motor responsive to said feed and bight analog signals, respectively, for positioning said stitch-forming instrumentalities to produce a pattern of stitches corresponding to the selected digital pattern stitch information; wherein the improvement comprises:

signal control operational amplifier means interposed between said feed digital-to-analog converter means and said feed closed loop servo means, and between said bight digital-to-analog coverter means and said bight closed loop servo means, each of said operational amplifier means having a feedback circuit including a rheostat;

switch means effective on operator command to insert a wiper on said rheostat in bypass arrangement in said feedback circuits, whereby the gain of said operational amplifier means may be varied the analog signal received from said feed and said bight digital-to-analog converter means and transferred, respectively, to said feed and said bight closed loop servo means.

2. In a sewing machine as claimed in claim 1 wherein said switch means include FET devices.

3. In a sewing machine as claimed in claim 2 wherein said switch means is made effective on operator command by a proximity detector responsive to the presence of an operators finger, and a flip-flop latch set by said proximity detector to retain said FET devices in the conductive state.

4. In a sewing machine as claimed in claim 3 further comprising:

manually controlled electrical means to compensate for work related differences between the actual feed and the feed represented by the analog signal derived from the stored information;

reverse switch means effective during reverse feed to insert said manually controlled electrical means in circuit for selectively adjusting said positional feed analog signals only during reverse feed.

5. In a sewing machine as claimed in claim 4 wherein said reverse switch means effective during reverse feed includes an FET device placed in a conductive state by said logic means responsive to a characteristic digital form for reverse feed extracted by said means for recovering selected pattern stitch information from said storage means.

6. In a sewing machine as claimed in claim 5 wherein said characteristic digital form for reverse feed includes an ON condition for the most significant bit.

7. In a sewing machine as claimed in claim 4 wherein said reverse switch means includes an FET device placed in a conductive state by logic means responsive to a characteristic digital form for the absence of forward feed as extracted by said means for recovering selected stitch information from said storage means.

8. In a sewing machine as claimed in claim 4 wherein said reverse switch means includes an FET device placed in a conductive state by logic means responsive to digital information indicative of reverse feed as extracted by said means for recovering selected stitch information from said storage means.

9. In a sewing machine having stitch-forming instrumentalities positionally controlled over a predetermined range between stitches to produce a pattern of feed and bight controlled stitches; logic means for storing pattern stitch information in digital form; means operating in timed relation with the sewing machine for recovering selected pattern stitch information from said logic means; feed and bight digital-to-analog converter means for generating positional feed and bight analog signals, respectively, related to said selected digital information; and feed and bight closed servo means including reversible electric motors responsive to said feed and bight analog signals, respectively, for positioning said stitch-forming instrumentalities to produce a pattern of stitches corresponding to the selected pattern stitch information; wherein the improvement comprises:

manually controlled electrical means to compensate for work related differences between the actual feed and the feed represented by the analog signal derived from the stored information;

reverse switch means effective during reverse feed to insert said manually controlled electrical means in circuit for selectively adjusting said positional feed analog signals only during reverse feed.

10. In a sewing machine having stitch forming instrumentalities including an endwise reciprocating needle and a work feeding mechanism capable of transporting work fabric in steps of varying magnitude and direction between successive needle reciprocation, means for generating and applying pattern stitch information to said stitch forming instrumentalities to produce a pattern of successive stitches including work feed pattern information relating to the length and direction of work transport between each successive needle penetration, operator influenced balancing means for selectively modifying the work feed pattern information relating to the length of work transport between each successive needle penetration, and means for rendering said balancing means effective only during the reverse direction of work transport in response to said pattern stitch information.

11. In a sewing machine having stitch forming instrumentalities positionally controlled over a predetermined range between stitches to produce a pattern of feed and bight controlled stitches, static memory means for storing pattern stitch information means operating in timed relation with the sewing machine for recovering selected pattern stitch information from said static memory means, separate actuating means responsive to said pattern stitch information for influencing the feed and the bight motions respectively to produce a pattern of stitches corresponding to the selected pattern stitch information, wherein the improvement comprises means effective to limit the operation of at least one of said feed and bight actuating means to a proportion of the motion dictated by said pattern stitch information, and switch means effective on command of the operator for rendering said proportional motion limiting means effective.

12. In a sewing machine having stitch forming instrumentalities positionally controlled over a predetermined range between stitches to produce a pattern of feed and of bight control stitches; logic means for storing pattern stitch information in digital form; means operating in timed relation with the sewing machine for recovering selected digital pattern stitch information from said logic means; feed digital-to-analog converter means and bight digital-to-analog converter means for generating positional feed and bight analog signals, respectively, related to said select digital pattern stitch information; and feed closed-loop servo means including reversible electric motor and bight closed-loop servo means including reversible electric motor responsive to said feed and bight analog signals, respectively, for positioning said stitch forming instrumentalities to produce a pattern of stitches corresponding to the selected digital pattern stitch information; wherein the improvement comprises:

manually controlled electrical means to compensate for work related differences between the actual feed and the feed represented by the analog signal derived from the stored information;

and reverse switch means effective during reverse feed to insert said manually controlled electrical means in circuit for selectively adjusting said positional feed analog signals only during reverse feed.

13. In a sewing machine as claimed in claim 12 wherein said reverse switch means effective during reverse feed includes an FET device placed in a conductive state by said logic means responsive to a characteristic digital form for reverse feed extracted by said means for recovering selected pattern stitch information from said storage means.

14. In a sewing machine as claimed in claim 13 wherein said characteristic digital form for reverse feed includes an ON condition for the most significant bit.

15. In a sewing machine as claimed in claim 12 wherein said reverse switch means includes an FET device placed in a conductive state by logic means responsive to a characteristic digital form for the absence of forward feed as extracted by said means for recovering selected stitch information from said storage means.

16. In a sewing machine as claimed in claim 12 wherein said reverse switch means includes an FET device placed in a conductive state by logic means responsive to digital information indicative of reverse feed as extracted by said means for recovering selected stitch information from said storage means.

* * * * *

Disclaimer 4,016,821.—*Philip Francis Minalaga,* Piscataway, N.J. ELECTRONIC CONTROL OF BIGHT, FEED AND FEED BALANCE IN A SEWING MACHINE. Patent dated Apr. 12, 1977. Disclaimer filed May 2, 1986, by the assignee, *The Singer Co.*

Hereby enters this disclaimer to claim 11 of said patent.

[*Official Gazette July 1, 1986.*]